US010774644B2

(12) United States Patent
Lamond

(10) Patent No.: US 10,774,644 B2
(45) Date of Patent: Sep. 15, 2020

(54) SYSTEM AND METHOD FOR FORMING A CAVITY IN A BACKFILLED STOPE

(71) Applicant: Sturda Inc., Val Caron (CA)

(72) Inventor: Robert Lamond, Azilda (CA)

(73) Assignee: Sturda Inc., Val Caron, Ontario (CA)

( * ) Notice: Subject to any disclaimer, the term of this patent is extended or adjusted under 35 U.S.C. 154(b) by 20 days.

(21) Appl. No.: 16/034,698

(22) Filed: Jul. 13, 2018

(65) Prior Publication Data

US 2019/0032486 A1 Jan. 31, 2019

(30) Foreign Application Priority Data

Jul. 26, 2017 (CA) ..... 2974555

(51) Int. Cl.

| | |
|---|---|
| ***E21F 15/02*** | (2006.01) |
| ***E21F 15/00*** | (2006.01) |
| ***E21C 41/16*** | (2006.01) |
| ***E21F 16/00*** | (2006.01) |
| ***E21F 15/08*** | (2006.01) |

(52) U.S. Cl.

CPC ..... *E21F 15/08* (2013.01); *E21C 41/16* (2013.01); *E21F 15/00* (2013.01); *E21F 15/02* (2013.01); *E21F 16/00* (2013.01)

(58) Field of Classification Search

CPC . E21F 15/02; E21F 15/04; E21F 16/00; E21F 16/02; E21F 15/00; E21F 15/005; E21F 15/06; E21F 15/08; E21C 41/00; E21C 41/16; E21C 41/18; E21C 41/20; E21C 41/22

USPC ..... 299/11

See application file for complete search history.

(56) References Cited

U.S. PATENT DOCUMENTS

| | | | | |
|---|---|---|---|---|
| 4,056,939 | A * | 11/1977 | Alvarez-Calderon | E21C 41/16 405/267 |
| 5,232,429 | A * | 8/1993 | Cizek | B31C 3/04 112/63 |
| 6,857,706 | B2 | 2/2005 | Hames et al. | |
| 8,424,973 | B2 | 4/2013 | Bodley et al. | |
| 2008/0196885 | A1* | 8/2008 | Roelofs | E21B 33/134 166/187 |
| 2008/0292537 | A1* | 11/2008 | Sano | C02F 1/4618 423/580.1 |
| 2010/0295359 | A1* | 11/2010 | Bodley | E21C 37/16 299/13 |

(Continued)

FOREIGN PATENT DOCUMENTS

| | | |
|---|---|---|
| CA | 2685783 | 2/2014 |

*Primary Examiner* — David J Bagnell
*Assistant Examiner* — Michael A Goodwin

(57) ABSTRACT

A system for forming a cavity in a backfill mixture comprising granular material and water positioned in an at least partially excavated stope. The system includes a base and a drainage tube assembly in an extended condition thereof. The drainage tube assembly extends between a lower end secured to the base and an upper end positioned above an upper surface of the backfill mixture. The extended drainage tube assembly includes a tube portion thereof with a permeable material and defining the cavity therein into which the water from the backfill mixture is drainable, through the permeable material. The system also includes a drainage pipe, for permitting the water that has drained into the cavity of the extended drainage tube assembly to exit the stope.

4 Claims, 9 Drawing Sheets

(56) References Cited

U.S. PATENT DOCUMENTS

| | | | | |
|---|---|---|---|---|
| 2011/0272402 | A1* | 11/2011 | Lamond | E21F 15/02<br>220/86.1 |
| 2014/0023444 | A1* | 1/2014 | Kingsley | E21F 15/04<br>405/302.4 |
| 2018/0238171 | A1* | 8/2018 | Moore | E21C 41/22 |

* cited by examiner

SYSTEM AND METHOD FOR FORMING A CAVITY IN A BACKFILLED STOPE

FIELD OF THE INVENTION

The present invention is a system and a method for draining a backfill mixture including granular material and water that is positioned in an excavated stope.

BACKGROUND OF THE INVENTION

Mined-out portions of stopes are often backfilled with tailings (often referred to as "backfill"), pumped into the stope from a mill. As is well known in the art, the tailings typically include substantial amounts of water. Draining the backfill is a difficult task that may take a long time. The undrained water can exert significant pressure on structures at the stope entrances (fill fences). The known practices tend to rely on relatively slow drainage, which results in substantial water pressure exerted against fill fences over extended periods of time.

For instance, a first "panel", or portion, of the ore may be removed, and the opening left by its removal may be backfilled. Typically, once the backfill has been drained sufficiently and "cured", a second "panel" of the ore is removed. Subsequent panels may also be removed, sequentially.

As is well known in the art, as an initial step in excavating the first panel, a raise (i.e., an elongate generally vertical opening) is formed at an outer end of the first panel, to provide a blasting void in which the broken ore caused by blasting the first panel is receivable. The raise may be formed by incremental drilling and blasting, or by a raise bore, or by any other conventional means. Driving a raise by conventional means is an extremely expensive and time-consuming process.

A blasting void is an opening into which some of the broken ore is partially directed by the blast. The blasting void is needed due to the rapid increase in volume of the blasted ground of the second panel, upon ignition of the blast.

In conventional mining, one of the first steps in mining the second panel would be to create a blasting void for the second panel. Typically, this is done by creating a substantially vertical void in the solid rock of the second panel (at one side or end of the second panel), by conventional means.

As is well-known in the art, the step of forming the blasting void for each panel is relatively expensive and time-consuming. Once the blasting void for the second panel is created, the second panel may be drilled using conventional drills, to produce a blasting pattern in the second panel designed to blast toward the blasting void. Subsequently, the second panel is blasted, and the broken ore therefrom is removed by conventional mucking methods.

After the broken ore of the second panel has been excavated, the opening created by the removal of the second panel is backfilled. Typically, the process is repeated with respect to a third and possibly further subsequent panels until the stope has been fully excavated.

SUMMARY OF THE INVENTION

For the foregoing reasons, there is a need for a drainage system and method for a backfilled stope that overcomes or mitigates one or more of the deficiencies of the prior art. Such deficiencies are not necessarily included in those described above.

In its broad aspect, the invention provides a system for forming a cavity in a backfill mixture comprising granular material and water positioned in an at least partially excavated stope. The system includes a base located on a floor that partially defines the at least partially excavated stope, and a drainage tube assembly in an extended condition thereof. The drainage tube assembly extends between a lower end secured to the base and an upper end positioned above an upper surface of the backfill mixture. The extended drainage tube assembly includes a tube portion thereof with a permeable material and defining the cavity therein into which the water from the backfill mixture is drainable, through the permeable material. The system also includes a drainage pipe, for permitting the water that has drained into the cavity of the extended drainage tube assembly to exit the stope.

Once the backfill has been sufficiently drained and is sufficiently firm to support further mining, the cavity created by the system may be used as a blasting void, for a panel to be subsequently blasted.

In another aspect, the invention provides a method of forming a cavity in a backfill mixture positioned in an at least partially excavated scope. The backfill mixture includes a granular material and water. The method includes providing a base on a floor partially defining the at least partially excavated stope, and providing a drainage tube assembly in a retracted condition thereof. The drainage tube assembly includes a tube portion having a permeable material, the drainage tube assembly extending between lower and upper ends thereof. The lower end is secured to the base. The upper end is attached to a connecting element that is suspended from a roof partially defining the at least partially excavated stope. With the connecting element, the upper end is raised to a predetermined position above the floor in which the drainage tube assembly is in an extended condition to locate a top end of the tube portion in a preselected location above the floor, the tube portion defining the cavity therein when the drainage tube assembly is in the extended condition. A drainage pipe in fluid communication with the cavity is provided, to enable the water that drains into the cavity to exit the stope via the drainage pipe. The at least partially excavated stope is backfilled with the backfill mixture to the extent that an upper surface of the backfill mixture positioned in the stope is below the top end of the tube portion. The water is permitted to flow into the cavity via the permeable material and to exit the stope via the drainage pipe.

The invention also includes using the cavity as a blasting void for a panel to be subsequently blasted.

BRIEF DESCRIPTION OF THE DRAWINGS

The invention will be better understood with reference to the attached drawings, in which.

DETAILED DESCRIPTION

Figure 4:
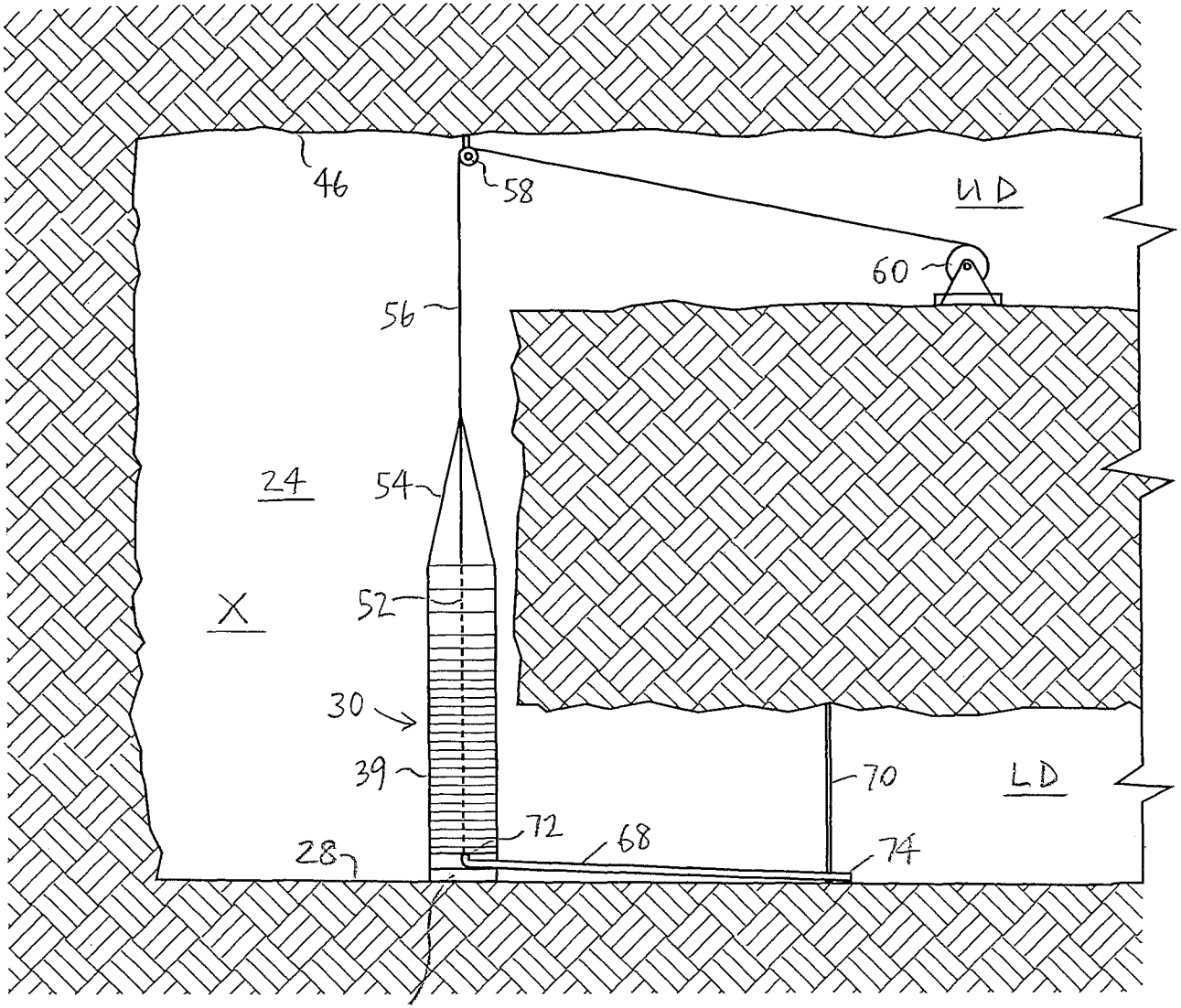
FIG. 4 is a cross-section of the partially excavated stope of FIGS. 1-3 in which the drainage tube assembly of FIG. 3 has been pulled upwardly a further second vertical distance by the winch, via the connecting element drawn through the pulley.
Figure 5:
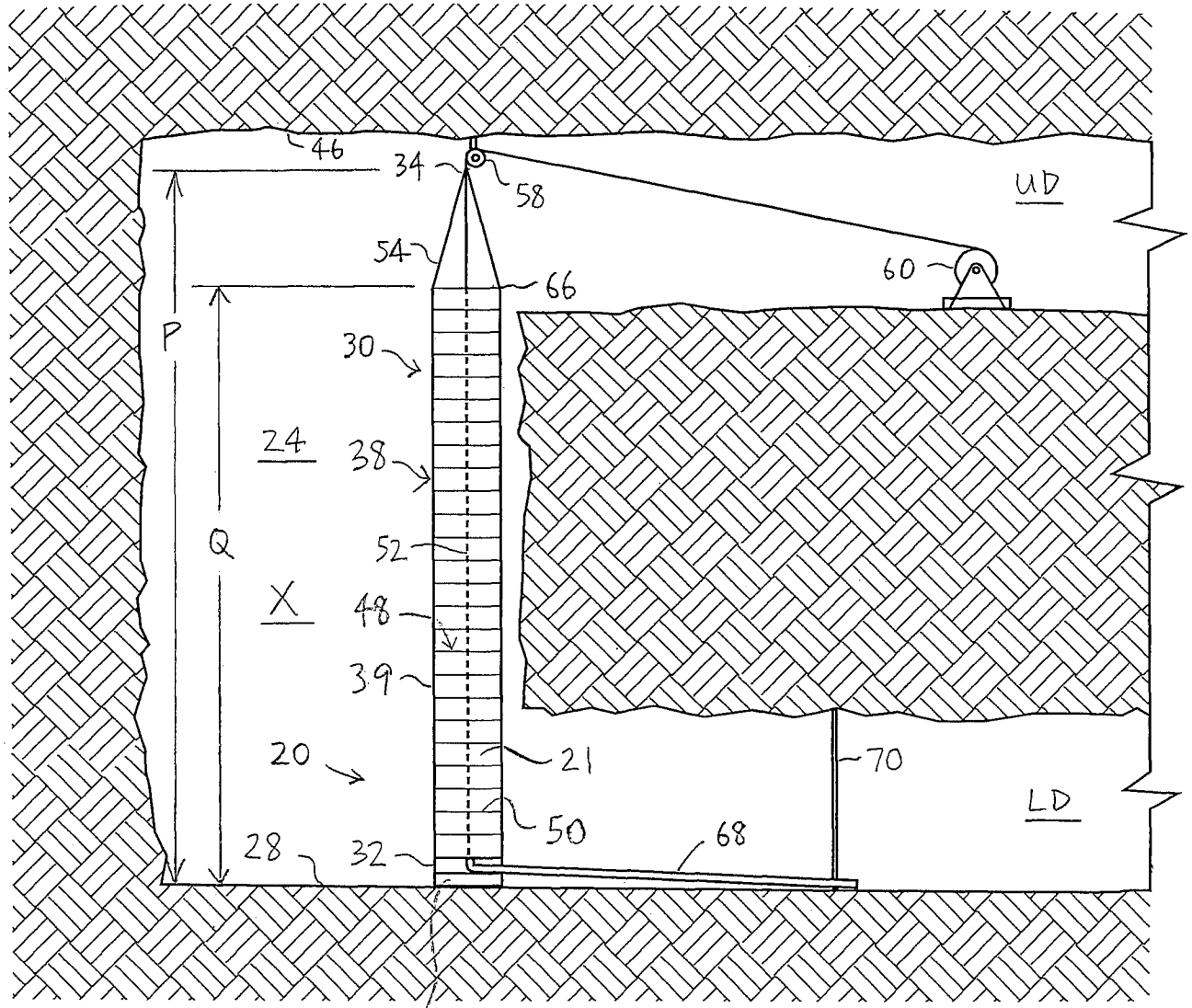
FIG. 5 is a cross-section of the partially excavated stope of FIGS. 1-4 in which the drainage tube assembly of FIG. 4 has been pulled upwardly to its fully extended condition by the winch, via the connecting element drawn through the pulley.
Figure 6:
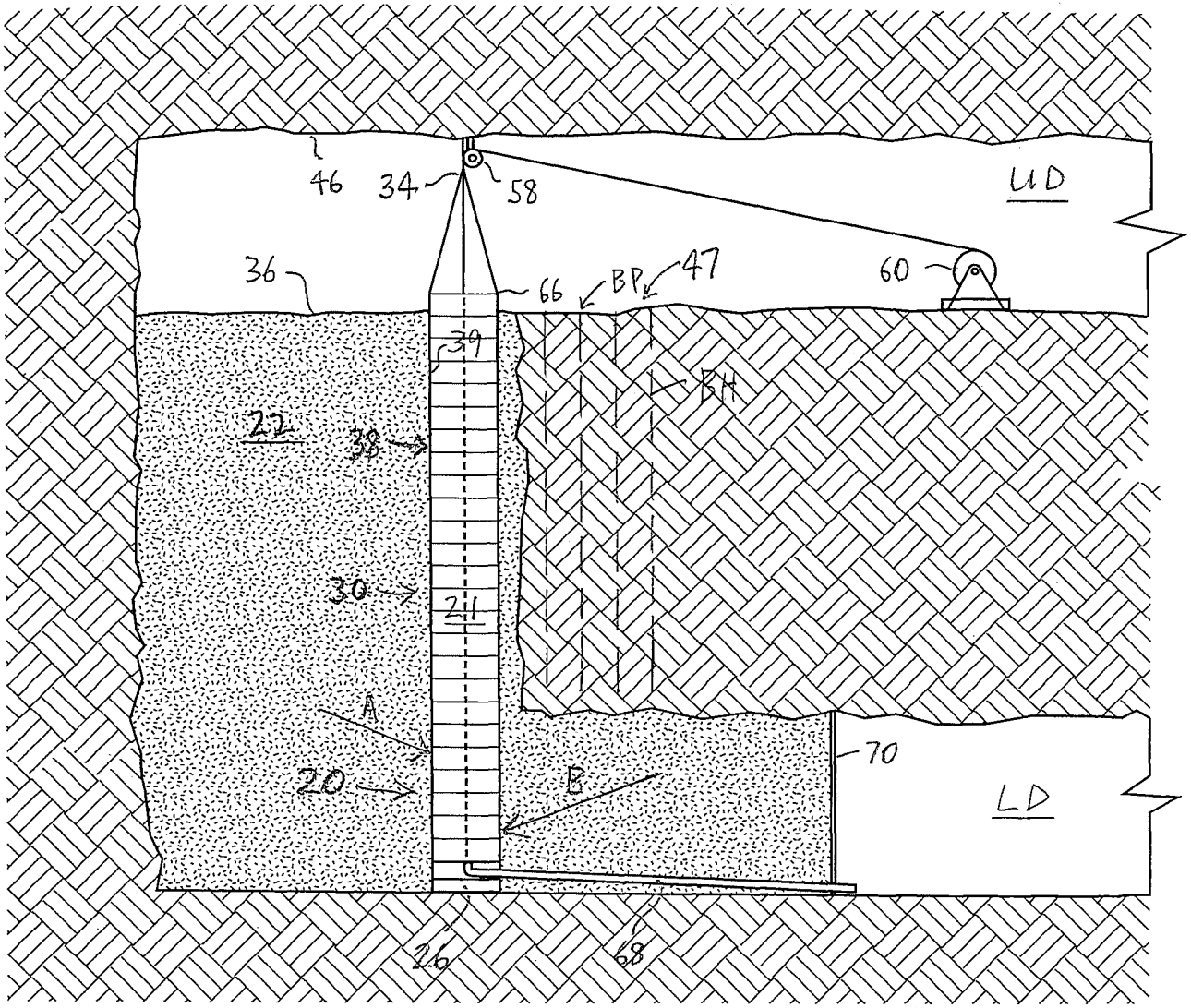
FIG. 6 is a cross-section of the partially excavated stope of FIGS. 1-5 in which a backfill mixture has been positioned in the partially excavated stope around the drainage tube assembly of FIG. 5.
Figure 7:
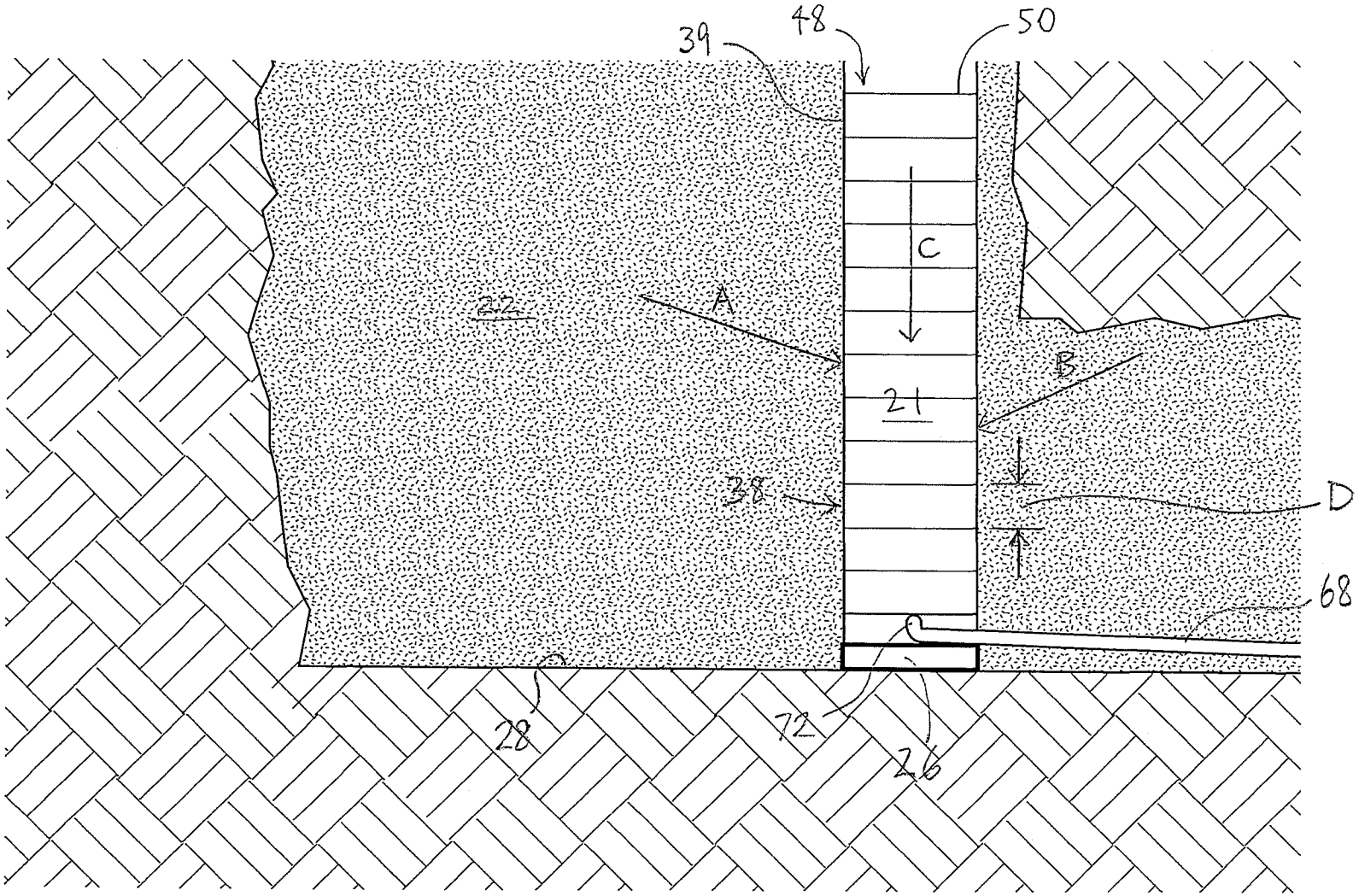
FIG. 7 is a portion of FIG. 6, drawn at a larger scale.
Figure 8:
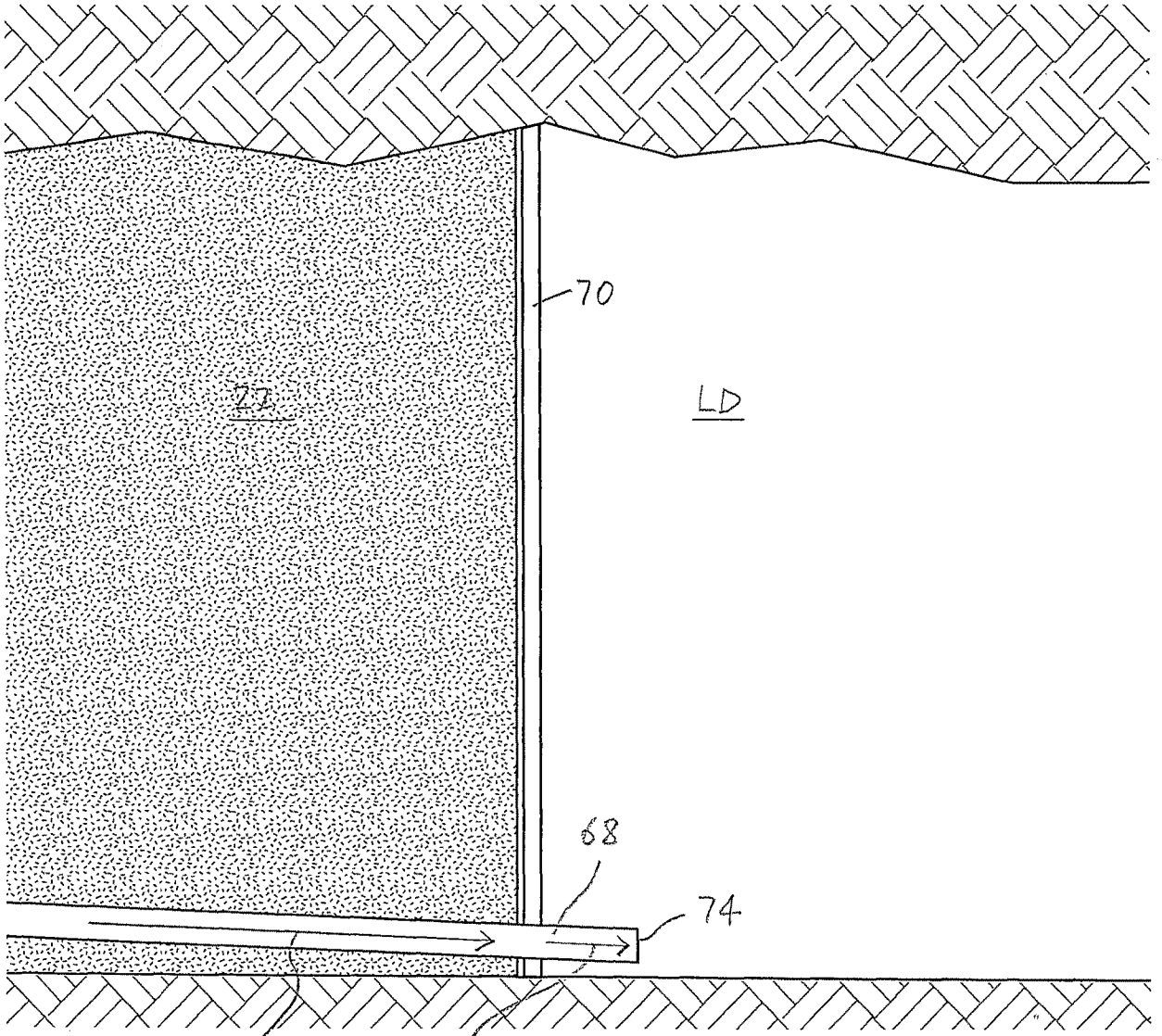
FIG. 8 is another portion of FIG. 6.
Figure 9:
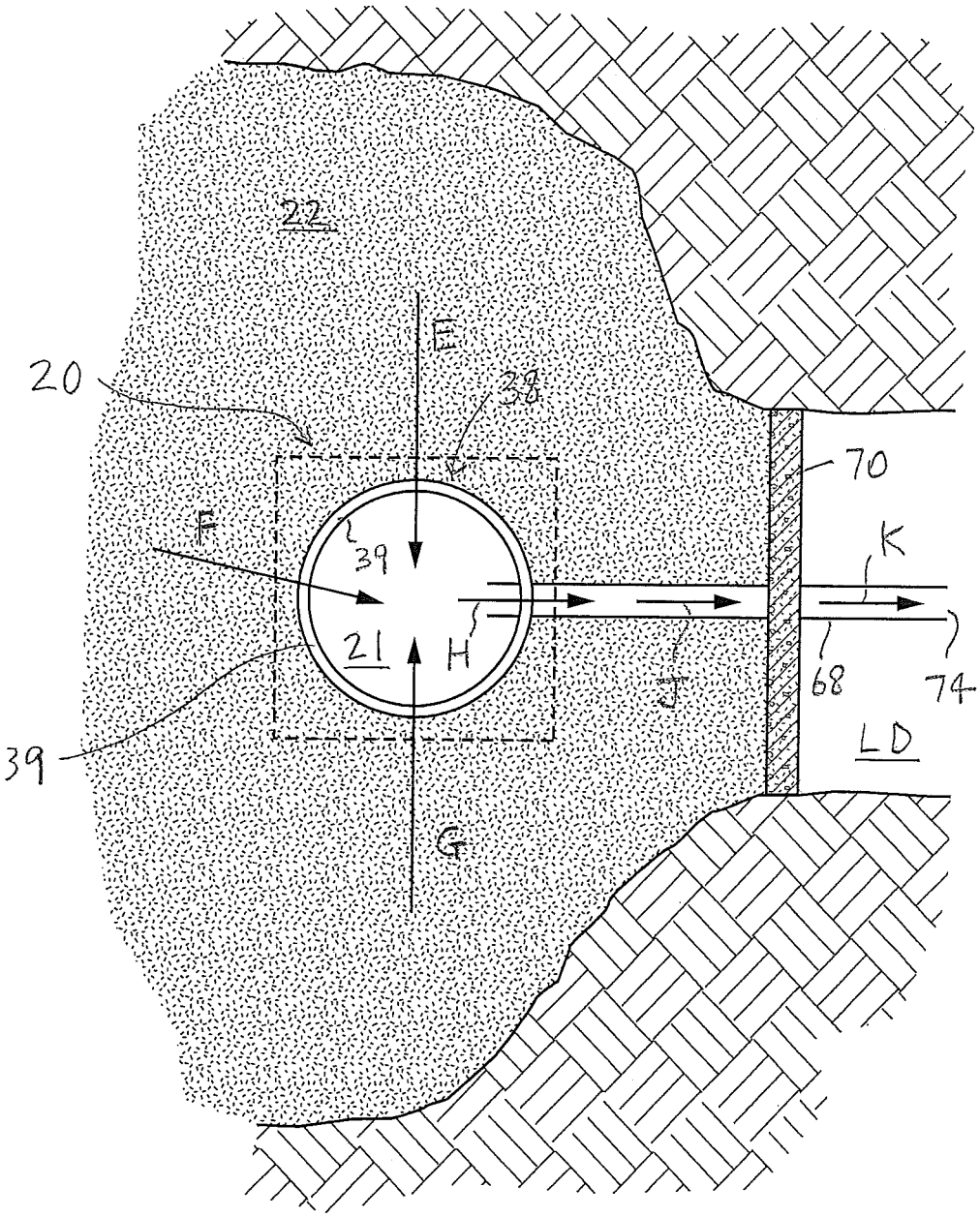
FIG. 9 is a top view of the drainage tube assembly of FIG. 6, drawn at a smaller scale.

In the attached drawings, reference numerals designate corresponding elements throughout. Reference is made to FIGS. 1-9 to describe an embodiment of a system in accordance with the invention indicated generally by the numeral 20 (FIGS. 5, 9). As will be described, the system 20 is for forming a cavity 21 in a backfill mixture 22 (FIGS. 6-9) comprising granular material and water positioned in an at least partially excavated stope 24 (FIGS. 1-5). In one embodiment, the system 20 preferably includes a base 26 (FIGS. 3-7, 9) located on a floor 28 (FIGS. 1-8) that partially defines the at least partially excavated stope 24 and a drainage tube assembly 30 in an extended condition thereof (FIGS. 5, 6). Preferably, and as can be seen in FIGS. 5 and 6, the drainage tube assembly 30 extends between a lower end 32 secured to the base 26 and an upper end 34 positioned above an upper surface 36 of the backfill mixture 22. It is also preferred that the extended drainage tube assembly 30 includes a tube portion 38 thereof (FIGS. 5, 9) comprising a permeable material 39 (FIG. 9) and defining the cavity 21 (FIGS. 5-7, 9) therein into which the water from the backfill mixture 22 is drainable, through the permeable material 39. The system 20 preferably also includes a drainage pipe 68, for permitting the water that has drained into the cavity 21 of the tube portion 38 to exit the stope 24.

Those skilled in the art would appreciate that the at least partially excavated stope 24 may be of any size, and as illustrated in FIGS. 1-5, includes an opening "X" partially defined by somewhat irregularly-shaped walls. As can be seen, for instance, in FIG. 1, the opening "X" in the partially excavated stope 24 is substantially defined by the floor 28, first and second side walls 42, 44, and a back, or roof, 46. Access to the stope 24 is provided by an upper drift "UD" and a lower drift "LD".

Those skilled in the art would appreciate that, in the partially-excavated stope illustrated in FIGS. 1-9, a first panel has been excavated, resulting in the opening "X". As is well-known in the art, the mining of the first panel may have commenced with the excavation of a raise (not shown) located at a side or an end of the first panel, using any suitable conventional method. It would also be understood by those skilled in the art that the raise would be needed to provide a blast void into which the broken ore of the first panel may be received, i.e., when the first panel is blasted, in production blasts.

In FIGS. 1-6, a second panel to be excavated in the stope is identified by reference numeral 47. It will be understood that the cavity 21 provided by the system and method of the invention may be used as a blast void in respect of the second panel 47.

Accordingly, in one embodiment of the method of the invention, after the cavity is formed, and when the backfill is sufficiently drained and cured to support the surrounding ground, a blast pattern "BP" is drilled in the second panel 47 to receive explosives (FIG. 6). The blast pattern "BP" is located proximal to the cavity, so that at least a portion of the broken ore pieces resulting from blasting the blast pattern is receivable in the cavity.

Those skilled in the art would appreciate that the system and method of the invention have significant advantages over conventional systems and methods. In particular, utilizing the cavity 21 formed by the drainage tube assembly as a blasting void for a subsequent panel results in a major cost reduction, and also permits faster mining of the subsequent panel. The system and method of the invention enable the operator, in connection with mining the second and subsequent panels, to avoid the significant costs and delays that accompany conventional raise mining methods.

As can be seen, e.g., in FIG. 6, in order for the cavity 21 to be used as a blast void for the subsequent panel, the drainage tube assembly 30 preferably is located proximal to the subsequent panel. It is believed that those skilled in the art would be able to determine an appropriate distance for the purpose between the subsequent panel and the drainage tube assembly. For example, as can be seen in FIG. 6, the drainage tube assembly 30 is positioned proximal to the face 44 of the second panel 47.

In FIG. 6, blastholes "BH" for a production blast of the second panel 47 are illustrated. The blastholes "BH" are drilled in the blast pattern "BP". Those skilled in the art would appreciate that the production blast preferably is designed to utilize the cavity 21 as the blasting void therefor, as described above.

The backfill mixture 22 may include any suitable granular material, and the water. Those skilled in the art would appreciate that the granular material may, for example, include tailings resulting from the mineral processing of the ore from the mine. It will be understood that the tailings granular material is generally relatively fine. Those skilled in the art would also appreciate that the backfill mixture may include cement and/or other materials intended to provide a backfill positioned in the stope (and once much of the water has drained away, and after time for curing) that will be cohesive to an extent, and therefore provide enhanced support to the walls and pillars defining the stope 24.

The permeable material 39 of the tube portion 38 preferably is any suitable material. For example, it is believed that a geotextile material would be suitable. For instance, a material with a tensile strength of approximately 600×700 lbs. (approximately 2,670×3,115 N), with an apparent opening size of 40 U.S. Std. Sieve (approximately 0.425 mm), and permittivity of 0.26/second allowing a water flow rate of approximately 20 U.S. gpm/ft$^2$ (approximately 815 lpm/m$^2$) is believed to be a suitable material. Those skilled in the art would be aware of other suitable permeable materials. It will be understood that, in FIG. 9, the thickness of the permeable material 39 has been exaggerated for clarity of illustration. As illustrated, for example, in FIGS. 5 and 7, the tube portion 38 preferably also includes a frame 48 which, in one embodiment, includes a number of rings 50 to which the permeable material 39 is secured. The rings 50 are made of any suitable strong material, e.g., steel. The rings 50 preferably are secured to the permeable material 39, so that the rings 50 support the permeable material 39 after installation. Because of the support provided by the rings 50, the permeable material 39 resists the backfill mixture 22 that presses against the permeable material 39 after the backfill mixture 22 has been positioned in the stope 24.

Figure 1:
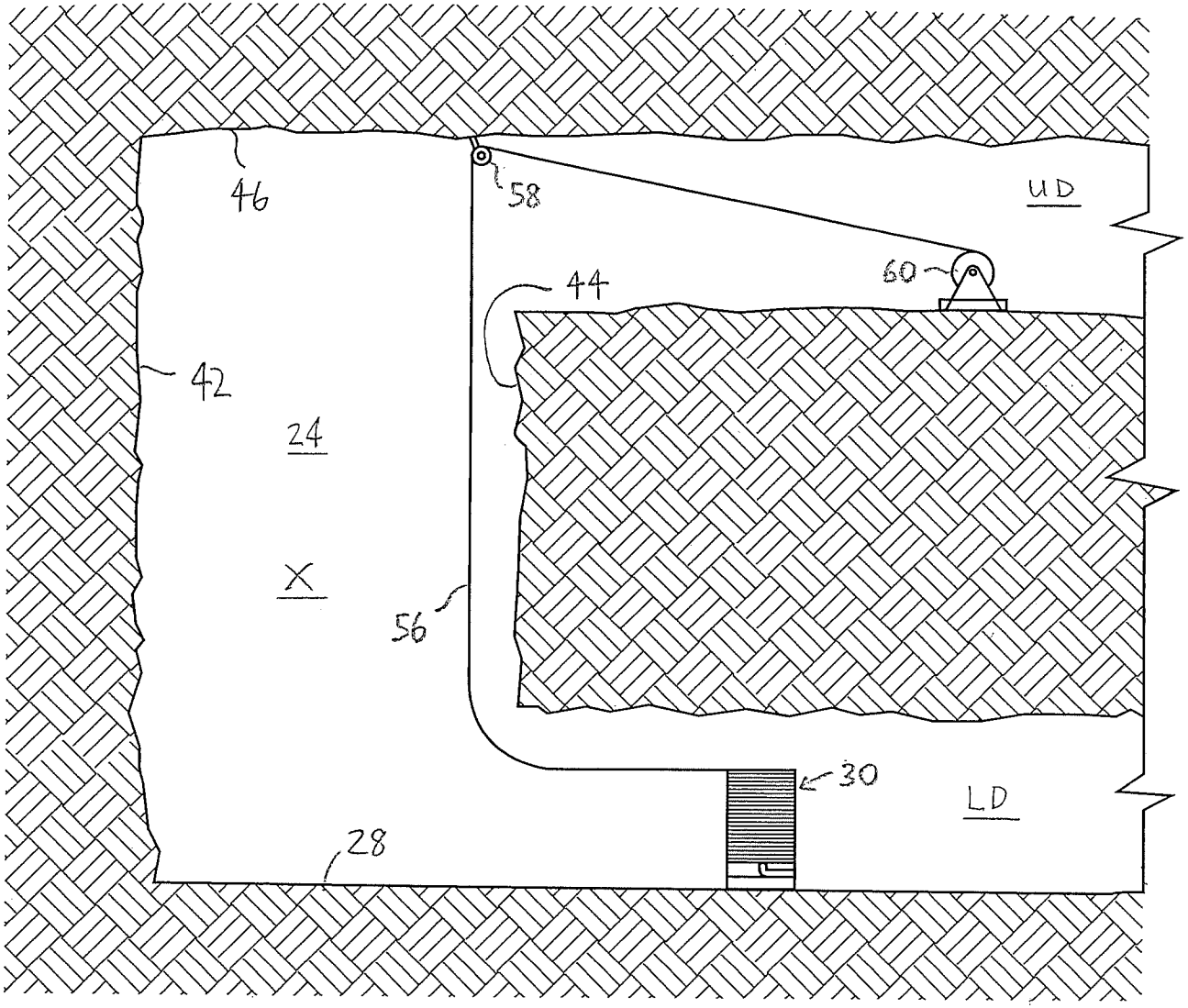
FIG. 1 is a cross-section of a partially excavated stope, with an embodiment of a drainage tube assembly of the invention positioned therein proximal to a drift, in a retracted condition.
Figure 2:
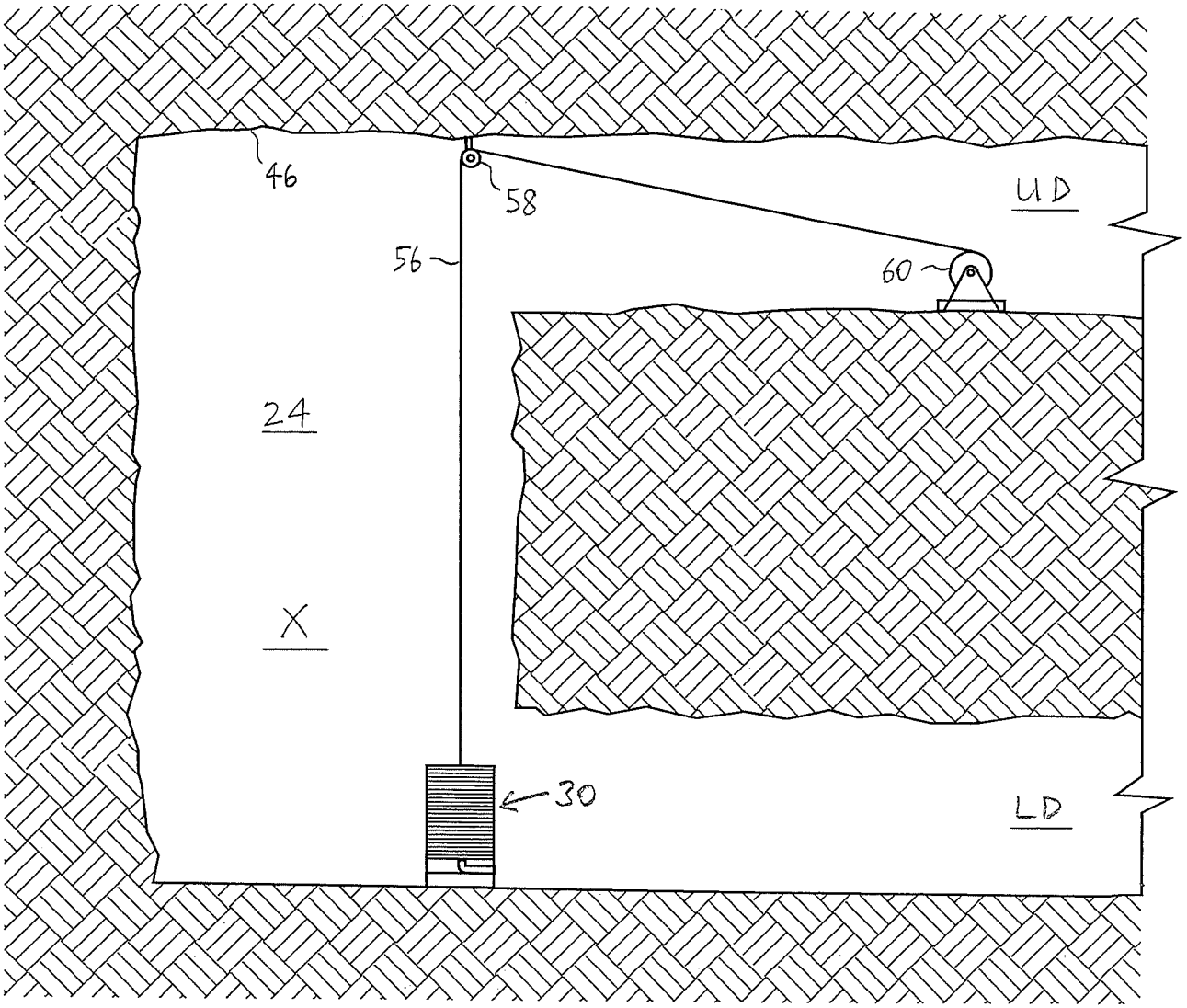
FIG. 2 is a cross-section of the partially excavated stope of FIG. 1 in which the drainage tube assembly of FIG. 1 is located substantially vertically aligned with a pulley secured in a back partially defining the partially excavated stope, the drainage tube assembly being located on a base.
Figure 3:
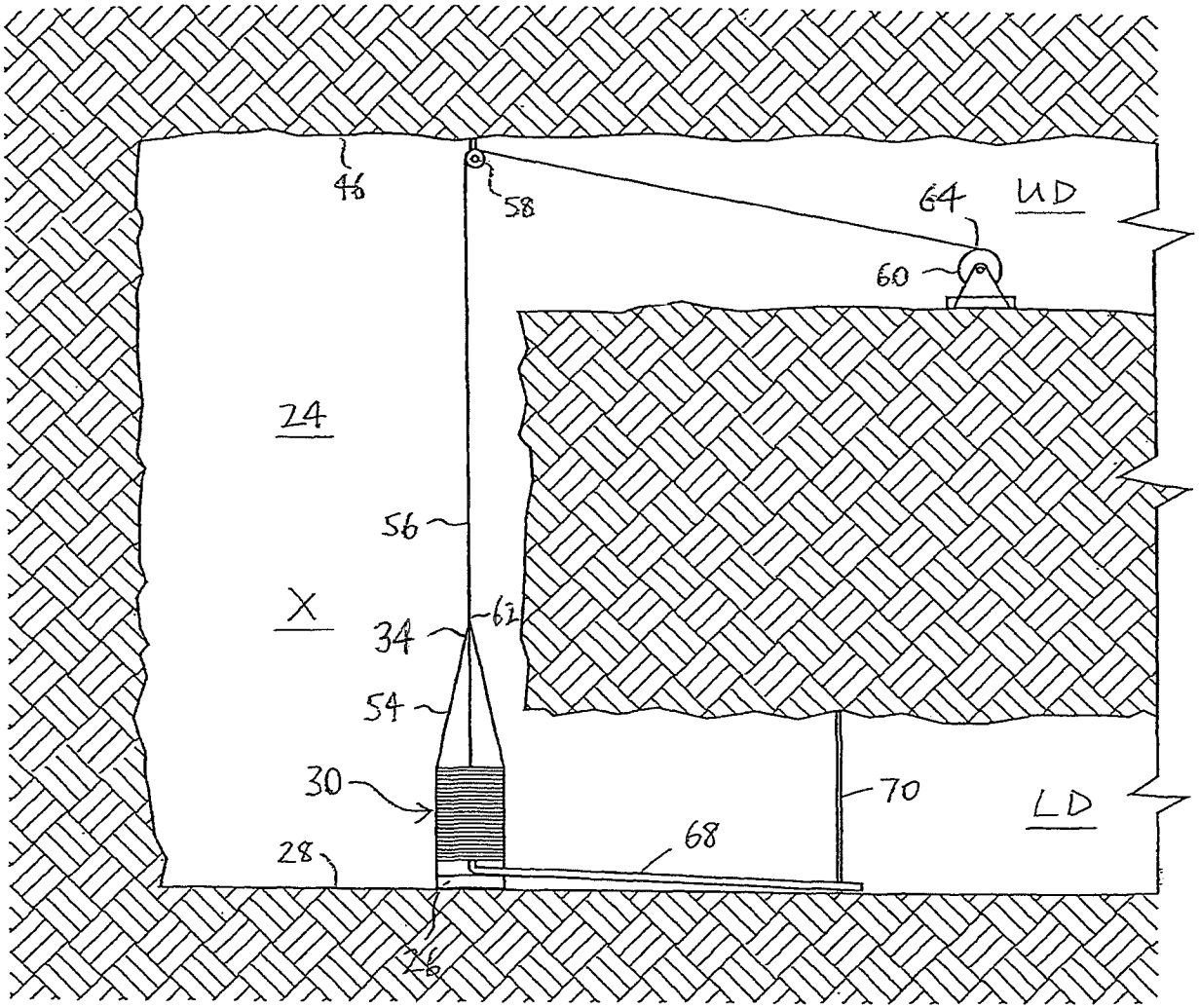
FIG. 3 is a cross-section of the partially excavated stope of FIGS. 1 and 2 in which the drainage tube assembly of FIG. 2 has been pulled upwardly a first vertical distance by a winch, via a connecting element drawn through the pulley, and in which a drainage pipe is connected with the drainage tube assembly.

When the drainage tube assembly 30 is in its retracted condition, the rings 50 are positioned proximal to each other, and may be piled so that they are substantially aligned (FIGS. 1-3). In FIG. 4, it can be seen that the tube portion 38 preferably extends smoothly as the upper end 34 of the drainage tube assembly 30 is pulled upwardly, with the rings 50 proximal to the upper end 34 being located in position spaced apart from each other sequentially, under the influence of gravity. The upper end 34 is pulled upwardly until the drainage tube assembly 30 is in its fully extended condition. As can be seen in FIGS. 5-7, once the drainage tube assembly 30 is in the extended condition thereof, the rings 50 preferably are vertically spaced apart from each other by a distance "D" respectively (FIG. 7). It is preferred that the rings 50 are connected with each other, in series, by one or more central connectors 52 (FIGS. 4-6) that preferably are included in the frame 48.

The connectors 52 may be made of any suitable material. Preferably, the connectors 52 are long pieces of wire, connected to the rings 50 respectively. In one embodiment, the frame 48 preferably includes three connectors 52, spaced angularly equidistant from each other so that they are attached to the rings respectively at approximately 120° from each other. When the drainage tube assembly 30 is in its extended condition, the connectors 52 preferably each extend from the topmost ring to the bottom-most ring, and each of the connectors 52 is also substantially straight. Those skilled in the art would appreciate that the connectors 52 serve to strengthen the frame 48, supporting the rings 50 so that permeable material 39 is supported by the frame against the backfill mixture 22 pressing against it.

Those skilled in the art would appreciate that, when the drainage tube assembly 30 is in its extended condition, the tube portion 38 may have any suitable dimensions. In addition, the frame 48 and its elements may have any suitable dimensions and configurations. For instance, the rings 50 may each have an inner diameter of approximately 60 inches (152.4 cm) and the cavity 21 therefore may have a minimum inner diameter of approximately 60 inches (152.4 cm) also. It is believed that the rings 50 should preferable be secured to the permeable material 39 so that "D" is approximately 24 inches (approximately 60.96 cm). As noted above, the rings 50 preferably are also connected to each other respectively by the one or more connectors 52.

In one embodiment, the drainage tube assembly 30 preferably also includes one or more suspension elements 54 secured to the frame 48, to attach the frame 48 (and ultimately, the rings 50, and the permeable material 39) with a connecting element 56 (FIGS. 3-5). As will also be described, the connecting element 56 preferably is used to raise the drainage tube assembly 30 from its retracted condition (FIG. 2) to its extended condition (FIG. 5). It is also preferred that the connecting element 56 remains in position after the drainage tube assembly 30 has been moved to its extended condition, to maintain the drainage tube assembly 30 in its extended condition.

An embodiment of a method of the invention includes providing the base 26 on the floor 28, and providing the drainage tube assembly 30 in the retracted condition thereof (FIG. 1). Those skilled in the art would appreciate that the base 26 may be made of any suitable materials, e.g., concrete. The lower end 32 of the drainage tube assembly 30 preferably is secured to the base 26. The lower end 32 may be secured to the base 26 in any suitable manner, using any suitable devices (not shown). Also, it will be understood that the base 26 is also secured to the floor 28 in any suitable manner. Those skilled in the art would be aware of suitable means for securing the base 26 to the floor 28, and also of suitable means for securing the lower end 32 to the base 26.

As can be seen in FIG. 1, the upper end 34 of the drainage tube assembly 30 preferably is attached to the connecting element 56. It is also preferred that the connecting element 56 is suspended from the back or roof 46 that partially defines the excavated stope 24. Those skilled in the art would appreciate that the connecting element 56 and the upper end 34 may be attached using any suitable means therefor. As can be seen in FIGS. 1-5, in one embodiment, a pulley 58 preferably is secured to the back 46, and a winch 60 is securely mounted in the upper drift "UD". Those skilled in the art would be aware of a suitable connecting element 56, a suitable pulley 58, and a suitable winch 60.

In one embodiment, and as can be seen in FIG. 3, the connecting element 56 extends between a first end 62 thereof that is attached to the upper end 34 of the drainage tube assembly 30, and a second end 64 thereof that is secured to the winch 60. It will be understood that the connecting element 56 preferably is passed through the pulley 58. It will also be understood that the drainage tube assembly 30 is shown in its retracted condition in FIGS. 1 and 2.

It will be understood that, when the connecting element 56 is attached to the drainage tube assembly 30, the drainage tube assembly 30 is located in a safe location (FIG. 1). Those skilled in the art would appreciate that the retracted drainage tube assembly 30 may be moved from its location in a "safe" area, as illustrated in FIG. 1, to its location as illustrated in FIG. 2 using any suitable means. For example, the retracted drainage tube assembly 30 may be moved into the location illustrated in FIG. 2 by a remotely-controlled vehicle that is suitably equipped (not shown). As shown in FIG. 2, the retracted drainage tube assembly 30 preferably is located substantially vertically below the pulley 58.

As can be seen in FIGS. 1-5, with the connecting element 56 attached to it, the upper end 34 is raised substantially vertically to a predetermined position preferably located a distance "P" (FIGS. 5, 6) above the floor 28 (FIG. 5). In FIGS. 5 and 6, it can be seen that when the upper end 34 is at the predetermined position "P", the drainage tube assembly 30 is in the extended condition thereof. When the drainage tube assembly 30 is in its extended condition, a top end 66 of the tube portion 38 preferably is located in a preselected position preferably located a distance "Q" above the floor 28. As can be seen in FIGS. 5, 6, and 9, it is preferred that the tube portion 38 defines the cavity 21 therein when the drainage tube assembly 30 is in the extended condition thereof.

It is also preferred that a drainage pipe 68 is included in the system 20. As will be described, the drainage pipe 68 preferably is in fluid communication with the cavity 21 (FIGS. 5-9), to enable the water that drains into the cavity 21 to exit the stope 24 via the drainage pipe 68.

Those skilled in the art would appreciated that, once the drainage tube assembly 30 is in the extended condition and the drainage pipe 68 is in position as illustrated in FIG. 5, the excavated stope 24 preferably is at least partially filled with the backfill mixture 22. It is preferred that the stope 24 is filled with the backfill mixture 22 to the extent that the upper surface 36 of the backfill mixture 22 that is positioned in the stope 24 is proximal to, but below, the top end 66 of the tube portion 38 (FIG. 6). The water in the backfill mixture 22 is permitted to flow into the cavity 21 under the influence of gravity via the permeable material 39, and to exit the stope 24 via the drainage pipe 68.

In use, the system 20 preferably additionally includes a fill fence 70 positioned at an entrance to the stope 24 in the lower drift "LD". Those skilled in the art would appreciate that the fill fence 70 preferably is formed to retain the granular material in the stope, and also to permit a portion of the water in the backfill mixture 22 to drain therethrough. As can be seen in FIGS. 5-8, the drainage pipe 68 preferably defines a slope that is downward from an inner end 72 of the drainage pipe 68 to an outer end 74 of the drainage pipe 68, to ensure that the water will drain from the inner end 72 to the outer end 74. It is also preferred that the inner end 72 is located inside the cavity 21, and on or only a small distance above the base 26, so that the drainage pipe 68 is in fluid communication with the cavity 21.

The outer end 74 of the drainage pipe 68 preferably is located outward from the fill fence 70, as illustrated in FIGS. 5-9, to ensure that the drainage pipe 68 empties the water into the lower drift "LD", outside the stope 24. Those skilled in the art would appreciate that the lower drift "LD" preferably grades downward from the stope entrance (i.e., downward from the fill fence 70), and water exiting the drainage pipe 68 at its outer end 74 therefore will not flow back into the stope. It will be understood that the water drained from the backfill mixture 22 as described above, and exiting the outer end 74 of the drainage pipe 68, ultimately flows to the general mine drainage system (not shown), and is subsequently pumped to the surface for treatment and release.

The flow of the water from the backfill mixture 22 into the cavity 21 is schematically represented by arrows "A" and "B" in FIGS. 6 and 7, and by arrows "E", "F", and "G" in FIG. 9. It will be understood that, at least shortly after the backfill mixture 22 has been emplaced in the excavated stope 24, the water from the backfill mixture 22 through the geotextile material 39 and may flow into the cavity 21 at substantially any and all points along the tube portion 38. The geotextile material 39 preferably screens much of the granular material, so that the water flows into the cavity 21 but the granular material generally does not. Because of this screening function, it is believed that the cavity 21 will remain empty except for the water, and will not be filled (or partially filled) with the granular material, for some time.

As schematically represented by arrow "C" in FIG. 7, the water that flows into the cavity 21 falls downwardly therein, under the influence of gravity. The water pools in the bottom part of the cavity 21, and flows through the drainage pipe 68 to the lower drift "LD", as schematically represented by arrows "H", "J", and "K" in FIG. 9. Arrows "J" and "K" are also shown in FIG. 8, for clarity of illustration.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

I claim:

1. A system for forming a cavity in a backfill mixture comprising granular material and water positioned in an at least partially excavated stope accessible via a lower drift, the at least partially excavated stope being partially defined by a floor, and a back located above the floor, the system comprising:

a base located on the floor of the at least partially excavated stope;

a fill fence to hold the backfill mixture in the stope, the fill fence being located between the stope and the lower drift, the fill fence having an inward side for engaging the backfill mixture in the stope, and an outward side facing away from the stope and into the lower drift;

a drainage tube assembly in an extended condition thereof, the drainage tube assembly extending between a lower end secured to the base and an upper end positionable above an upper surface of the backfill mixture, the extended drainage tube assembly comprising a tube portion thereof comprising a permeable material that holds the granular material in the stope and permits the water to pass therethrough, the tube portion defining the cavity therein, into which the water from the backfill mixture is drainable under the influence of gravity through the permeable material;

a drainage pipe extending between an inner end thereof located in the cavity at the lower end of the drainage tube assembly and an outer end thereof positioned in the lower drift outwardly from the outward side of the fill fence, the drainage pipe being positioned to drain the water from the cavity to the lower drift;

the tube portion comprising a frame secured to the permeable material, to support the permeable material when the drainage tube assembly is in the extended condition, and the granular material engages the permeable material;

the frame comprising:

a plurality of rings secured to the permeable material, the rings being vertically spaced apart from each other when the drainage tube assembly is in the extended condition thereof; and a plurality of connectors, connecting the rings vertically to each other when the drainage tube assembly is in the extended condition thereof.

2. A system according to claim 1 in which the drainage tube assembly comprises at least one connecting element suspended from the back and connected with at least one suspension element that is attached to the frame.

3. A system according to claim 2 comprising a pulley secured to the back through which the connecting element is passed.

4. A system according to claim 3 additionally comprising a winch, the connecting element extending between a first end attached to said at least one suspension element and a second end attached to the winch, whereby the drainage tube assembly is raiseable by the winch to the extended condition thereof.

* * * * *